US006438878B1

(12) United States Patent
Fine et al.

(10) Patent No.: US 6,438,878 B1
(45) Date of Patent: Aug. 27, 2002

(54) PHOTO DISPLAY GLOBE WITH LIQUID FILLED COMPONENTS

(75) Inventors: Neil Fine, Northbrook, IL (US); Cliff Lam, Tsuen Wan (HK)

(73) Assignee: Neil Enterprises, Inc., Vernon Hills, IL (US)

( * ) Notice: Subject to any disclaimer, the term of this patent is extended or adjusted under 35 U.S.C. 154(b) by 0 days.

(21) Appl. No.: 09/491,306

(22) Filed: Jan. 25, 2000

Related U.S. Application Data

(63) Continuation-in-part of application No. 09/044,039, filed on Mar. 18, 1998.

(51) Int. Cl.[7] ..... G09F 19/00

(52) U.S. Cl. ..... 40/409; 40/406; 40/734; 40/737

(58) Field of Search ..... 40/406, 409, 734, 40/736; 446/431; 473/594

(56) References Cited

U.S. PATENT DOCUMENTS

| | | | |
|---|---|---|---|
| 777,305 | A | 12/1904 | Priestnall |
| 1,777,944 | A | 10/1930 | Trovato |
| 2,144,551 | A | 1/1939 | Skolnick |
| 2,200,696 | A | 5/1940 | L'Heureux |
| 2,518,502 | A | 8/1950 | Snyder |
| 2,548,706 | A | 4/1951 | Corning |
| 2,636,597 | A | 4/1953 | Hinz |
| 3,822,782 | A | 7/1974 | Ringle |
| 4,224,364 | A | 9/1980 | Hunt |
| 4,353,327 | A | 10/1982 | Shroyer |
| 4,771,902 | A | 9/1988 | Teng |
| 4,837,955 | A | 6/1989 | Grabhorn |
| 4,879,824 | A | 11/1989 | Galloway |
| 4,889,748 | A | 12/1989 | Dudley |
| 5,125,175 | A | 6/1992 | Huff |
| 5,261,848 | A | 11/1993 | Kaplan et al. |
| 5,292,564 | A | 3/1994 | Lee |
| 5,442,869 | A | 8/1995 | McDarren et al. |
| D375,411 | S | 11/1996 | Hawkins |
| 5,609,252 | A | 3/1997 | Koch |
| 5,666,750 | A | 9/1997 | Segan |
| 5,713,147 | A | 2/1998 | Johnson |
| 5,853,824 | A | 12/1998 | Liu |
| 5,967,352 | A | 10/1999 | Repp et al. |

FOREIGN PATENT DOCUMENTS

| | | |
|---|---|---|
| FR | 2067084 | 12/1969 |

OTHER PUBLICATIONS

Silvestri, Inc., "Silvestri Spring 1991 Catalog", p. 20, published at least as early as 1991.

Russ Berrie and Company, Inc., "Timeless Moments Frames From Russ", p. 15, published at least as early as 1993.

*Primary Examiner*—Cassandra H. Davis

(74) *Attorney, Agent, or Firm*—Shaftal and Associates, Ltd.

(57) ABSTRACT

A novelty item comprising a first reservoir, a second reservoir, and a member for engaging the first and second reservoirs to define a display chamber. At least one of the first and second reservoirs includes a fluid therein and at least a portion of at least one of the first and second reservoirs is substantially transparent or translucent. The display chamber is capable of retaining an object therein for display.

17 Claims, 4 Drawing Sheets

PHOTO DISPLAY GLOBE WITH LIQUID FILLED COMPONENTS

This is a continuation in part of copending application Ser. No. 09/044,039. filed Mar. 18, 1998.

BACKGROUND OF THE INVENTION

1. The Technical Field

The invention relates to novelty displays in general, and, more particularly, to a novelty display having liquid-filled components and a dry display chamber.

2. The Prior Art

Display globes having liquid-filled shells have long been known in the art. Such display globes typically comprise a statuette or other object contained in a transparent shell which is filled with a liquid to which particulate matter has been added. The liquid and particulate may be agitated to give the effect of snow swirling about the object contained in the shell. With this type of display globe, the object which is to be displayed within the globe is, by design, in direct contact with the liquid. As such, this type of globe is generally limited to use with display objects which are impervious to immersion in liquid. Further more, this type of display globe is typically of permanently sealed construction. Therefore, the display items or objects housed therein typically cannot be replaced by the ultimate user, without damaging the globe.

A second type of display globe which has long been known in the art typically comprises a liquid-filled annular shell which is placed over a statuette or other object which is, in turn, supported on a base. Particulate matter has typically been added to the liquid in the annular shell, giving the effect of swirling snow when the liquid is agitated. With this type of globe, the item to be displayed remains dry. As such, this type of display globe is particularly well suited for use with display items which cannot readily be immersed in a liquid without becoming damaged, such as display items comprising paper articles.

As a practical matter, at least a portion of the display item housed in the second type of display globe will be relatively distant from the liquid-filled, annular shell. Because the display item is so far removed from and, of course, not immersed in the liquid, the "swirling snow" effect produced by the particulate matter in the liquid is less dramatic in the second type of display globe as compared to the first type.

Thus, it is an object of the present invention to provide a liquid-filled display globe which can be used to display items without immersing the items in the liquid.

It is another object of the invention to provide such a display globe in which the item to be displayed, although not immersed in the liquid, is sufficiently proximate the liquid to give the appearance that it is immersed therein.

It is a further object of the present invention to provide a liquid-filled display globe in which the display items can be easily replaced by the user, without damaging the globe.

These and other objects of the invention will become apparent in light of the present specification, claims, and drawings.

SUMMARY OF THE INVENTION

The present invention is a novelty item comprising a first reservoir, a second reservoir, and means for engaging the first and second reservoirs to define a display chamber. At least one of the first and second reservoirs includes a fluid therein and at least a portion of at least one of the first and second reservoirs is substantially transparent or translucent. The display chamber is capable of retaining an object therein for display.

In a preferred embodiment, at least a portion of each of the first and second reservoirs is substantially transparent or translucent.

In another preferred embodiment, each of the first and second reservoirs include a fluid therein. In one such embodiment, the fluid in each of the first and second reservoirs includes at least one solid particle suspended therein.

Preferably, at least one of the first and second reservoirs includes a spherical outer wall. In one such embodiment, the outer wall of each of the first and second reservoirs comprises a spherical geometry.

In yet another preferred embodiment, the inner wall of at least one of the first and second reservoirs comprises a substantially flat and planar geometry. In one such embodiment, the inner wall of both of the first and second reservoirs comprise a substantially flat and planar geometry.

In a preferred embodiment, the engaging means comprises a first threadform positioned on the first reservoir and a mating threadform positioned on the second reservoir. In another preferred embodiment, the engaging means comprises one of a pressfit engagement structure and a threaded engagement structure.

Preferably, the fluid which is contained in the reservoirs comprises at least two immiscible fluids.

In another preferred embodiment the first and second reservoirs each include at least one port capable of providing access to the reservoir.

Preferably, the object comprises a photograph. It is likewise contemplated that the object comprises two photographs positioned in a back to back orientation, to in turn, facilitate viewing of at least one photograph through each of the first and second reservoirs.

In a preferred embodiment, the novelty item further includes an attachment member associated with at least one of the first and second reservoirs. In one such embodiment, the attachment member further includes a key chain. In another such embodiment, the attachment member further includes a hook for attachment to an outside structure for decoration.

DETAILED DESCRIPTION OF THE INVENTION

Figure 1:
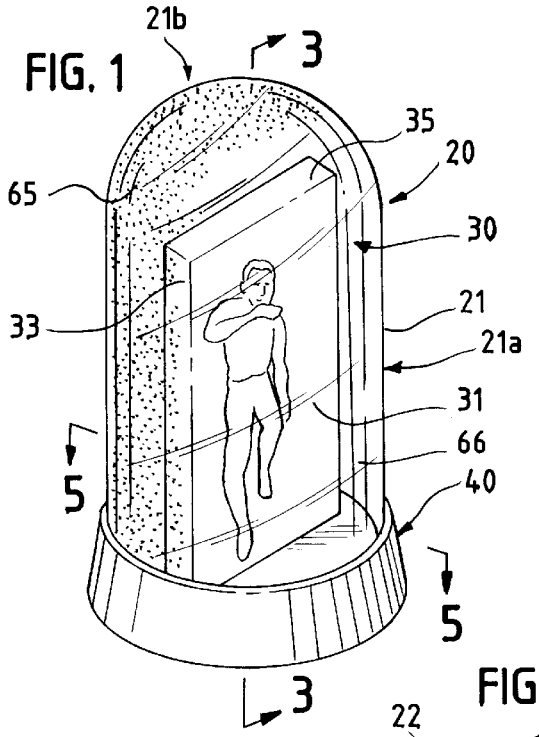
FIG. 1 is a perspective view of a photo display globe comprising an upper housing and a base.

While this invention is susceptible of embodiment in many forms, there is shown in the drawings, and will be described in detail herein, a preferred embodiment, with the understanding that the present disclosure is to be considered an example of the principles of the invention and is not intended to limit the invention to the embodiment illustrated.

The drawings illustrate a photo display globe according to a preferred embodiment of the invention. The photo display globe comprises housing 20, display chamber 30, liquid 50, and may also include base 40. In particular, referring to FIGS. 1, 3, and 5, housing 20 comprises upper shell 21, bottom 25, and aperture 29. Housing 20 may further include drain port 26 and a drain plug 27.

Figure 6:
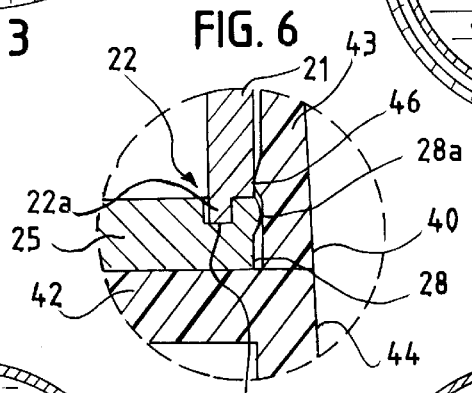
FIG. 6 is a side sectional detail view of an interface between an upper housing of a photo display globe and a base for a photo display globe.

Upper shell 21 is illustrated as having substantially cylindrical side wall portion 21*a* that is coextensive with and integrally associated with substantially hemispherical top wall portion 21*b*. It is contemplated that upper shell 21 may be of other shapes, as well, such as cubic, for example. Referring also to FIG. 6, upper shell 21 includes bottom edge 22 which may further comprise longitudinally-extending tab 22*a*.

Figure 3:
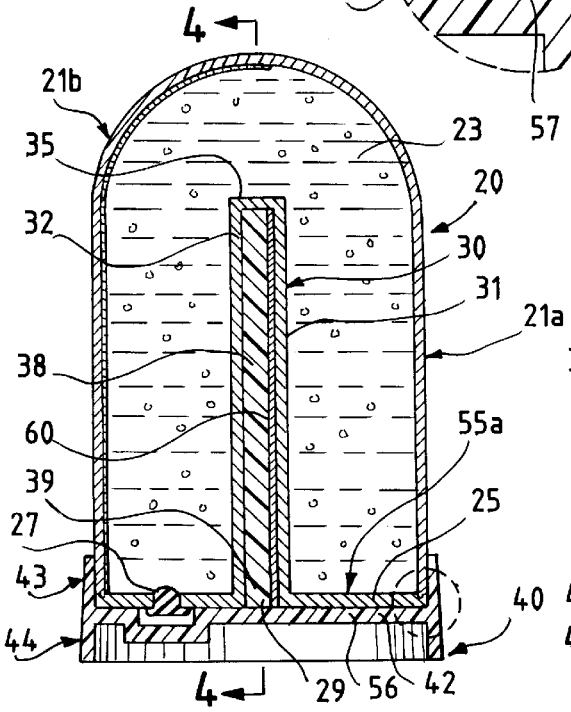
FIG. 3 is a side sectional elevation view of a photo display globe comprising an upper housing and a base.

Bottom 25, as shown in FIGS. 3 and 6, includes inner surface 55, outer surface 56, peripheral edge 28, and outwardly projecting peripheral ridge 28*a* integrally associated with peripheral edge 28. Inner surface 55 of bottom 25 may further comprise groove 57 which is sized and shaped to substantially conform with the shape and dimensions of bottom edge 22 and/or tab 22*a* of upper shell 21. In a preferred embodiment, bottom 25 is substantially planar and circular and includes groove 57 located adjacent peripheral edge 28. In alternate embodiments, bottom 25 may be of different shapes and cross sections, such as square.

In a preferred embodiment, bottom 25 may further comprise an aperture defining drain port 26. Embodiments which comprise drain port 26 also comprise drain plug 27 which may be removably inserted into drain port 26. Although the drawings illustrate drain port 26 and drain plug 27 as being associated with bottom 25, it is contemplated that the drain port and drain plug may be associated with other portions of the housing 20, such as upper shell 21.

Bottom edge 22 of upper shell 21 cooperates with bottom 25 to form a liquid-tight inner portion or cavity 23. In a preferred embodiment, tab 22*a* extending from bottom edge 22 of upper shell 21 matingly engages with circumferential groove 57 in bottom 22. In order to enhance the housing's 20 desired liquid-tight characteristics, tab 22*a* may be chemically bonded to groove 57 using a suitable adhesive. Alternatively, or additionally, a suitable sealant may be applied to the tab/groove interface after tab 22*a* and groove 57 have been assembled.

Figure 4:
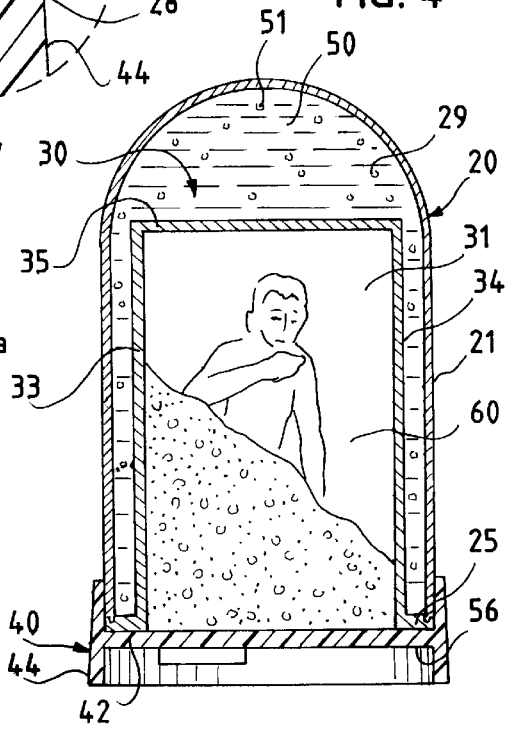
FIG. 4 is a front sectional elevation view of a photo display globe comprising an upper housing and a base.

Display chamber 30 is illustrated in FIGS. 1, 3, and 4 as comprising front wall 31, rear wall 32, two side walls 33 and 34, and top wall 35, which cooperate to define a substantially rectangular chamber having an interior region, an exterior region, and an open bottom 39. Front wall 31 is contemplated to be substantially transparent. The display chamber may further comprise support member 38. In a preferred embodiment, display chamber 30 is configured to receive thin object 60. In other embodiments, display chamber 30 may have more or fewer walls so as to define other shapes.

Display chamber 30 is integral with housing 20 and extends from the outer portion of the housing into an interior region (cavity 23) of the housing, so that the exterior region of the display chamber is substantially coextensive with cavity 23. In a preferred embodiment, display chamber 30 is substantially integral with bottom 25, extending from the outer portion of housing 20 into cavity 23. Alternatively, display chamber 30 may be integral with any other suitable portion of the housing, such as cylindrical side wall portion 21*a* of upper shell 21.

Figure 5:
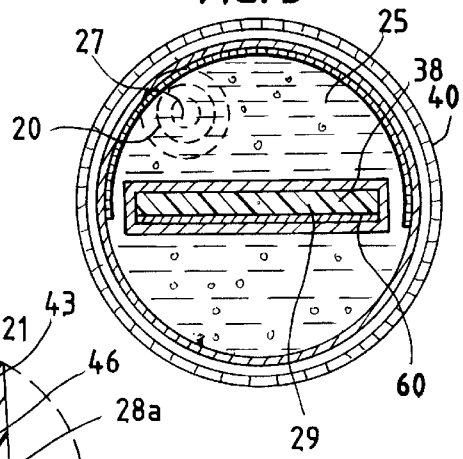
FIG. 5 is a top sectional plan view of a photo display globe.

Referring to FIG. 5, open bottom 39 of display chamber 30 is coextensive with aperture 29. Thin object 60, which may be a photograph or similar thin sheet, may be inserted into interior region of display chamber 30 through aperture 29 so as to be substantially viewable through substantially transparent upper shell 21 and substantially transparent front wall 31 of the display chamber. Support member 38 comprising, for example, a piece of expanded foam having dimensions substantially similar to the dimension of the interior region of display chamber 30, may be placed between thin object 60 and rear wall 32 of the display chamber so as to maintain the thin object in abutting relationship with the front wall.

Liquid 50 is contemplated to be substantially transparent and to have a desired, predetermined specific gravity and viscosity. Liquid 50 may include particles 51 which may become suspended in the liquid when the liquid is agitated. It is contemplated that cavity 23 be substantially entirely filled with liquid 50. Liquid 50 may be introduced into cavity 23 through drain port 26, whereafter drain plug 27 may be installed to preclude undesired loss of the liquid from the cavity.

Figure 2:
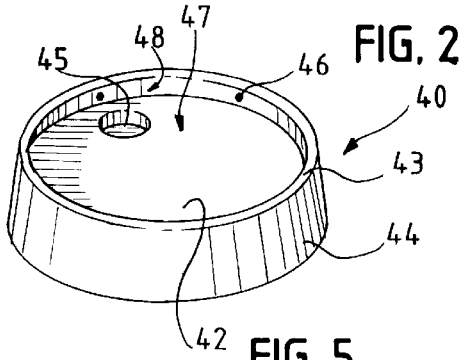
FIG. 2 is a perspective view of a base for a photo display globe.

Base 40, as illustrated in FIGS. 2 through 4, comprises web 42, upper wall 43, lower wall 44, well 45, and a plurality of bumps 46. In a preferred embodiment, web 42 is substantially planar and circular. Upper wall 43 extends upward from the web 42, defining recess 47, while lower wall 44 extends downward from the web. Bumps 46 are contemplated to be integral with inner surface 48 of upper wall 43. Well 45 comprises a depression in web 42 which is configured for slidingly mating engagement with drain port 26 and drain plug 27.

Housing 20 may be removably received into recess 47 so that outer surface 56 of bottom 25 is placed into abutting relationship with web 42 and so that drain port 26 and drain plug 27 may be slidingly and matingly inserted into well 45. Peripheral ridge 28*a* of bottom 25 matingly engages with bumps 46 to, in turn, selectively secure base 40 to housing 20.

Referring to FIG. 1, rear portion 65 of housing 20 may be coated or treated so as to be rendered substantially opaque. It is contemplated that front portion 66 of housing 20, which is operably associated with front wall 31 of display chamber 30, be substantially transparent, so as to allow viewing of an object within display chamber 30.

In use, base 40 may be removed from housing 20, thus allowing access to aperture 29 and the interior region of display chamber 30. Support 38 and thin object 60, which may be a photograph or other thin sheet, may be inserted into the interior region of the display chamber, so that the thin object is in abutting relationship with the front wall 31 of the display chamber. Base 40 may then be reattached to the bottom of the housing 20, and the photo display globe may be placed on a table, desk, shelf, or other surface where a decorative novelty item is desired. The photo display globe may be agitated, as desired, so as to actively place particles 51 into suspension with liquid 50, and, in turn, give the appearance of swirling snow around the object displayed in the display chamber.

Figure 7:
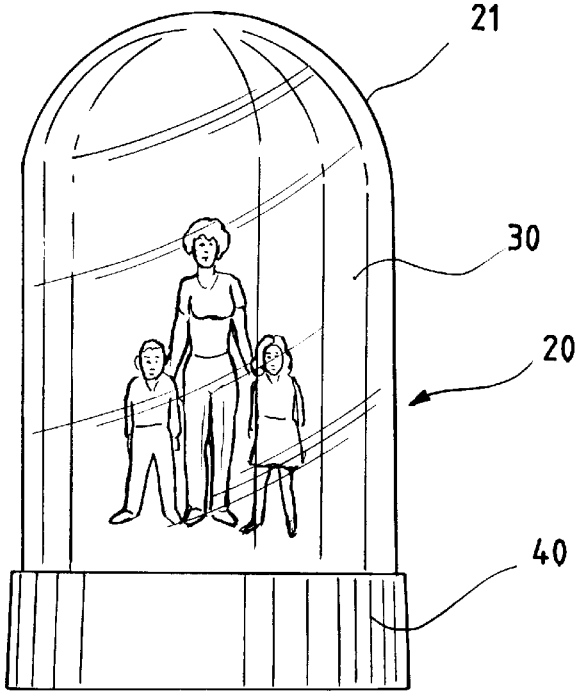
FIG. 7 is a side elevational view of another embodiment of the invention.

In another embodiment of the invention, and as shown in FIG. 7, display chamber 30 may have a configuration which, for example, follows the outer contours of upper shell 21. Specifically, in such an embodiment, the size of the display chamber can be maximized. Of course, other shapes, such as triangles, prisms, and other polygons are likewise contemplated for use. Additionally, base 40 may include a chamber capable of holding a music playing device, such as a conventional wind-up music box or a small radio transmitter.

Figure 8:
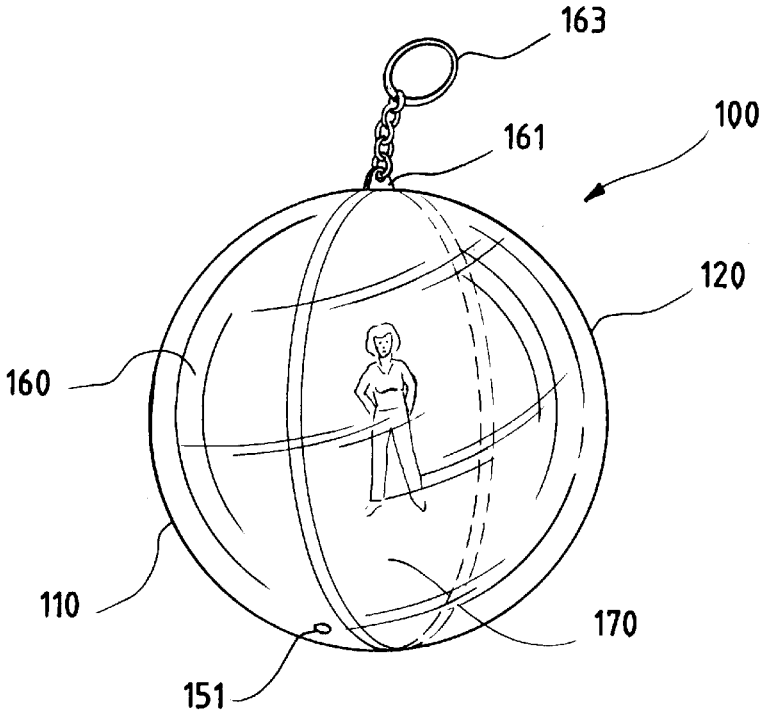
FIG. 8 is a perspective view of another embodiment of the present invention.
Figure 9:
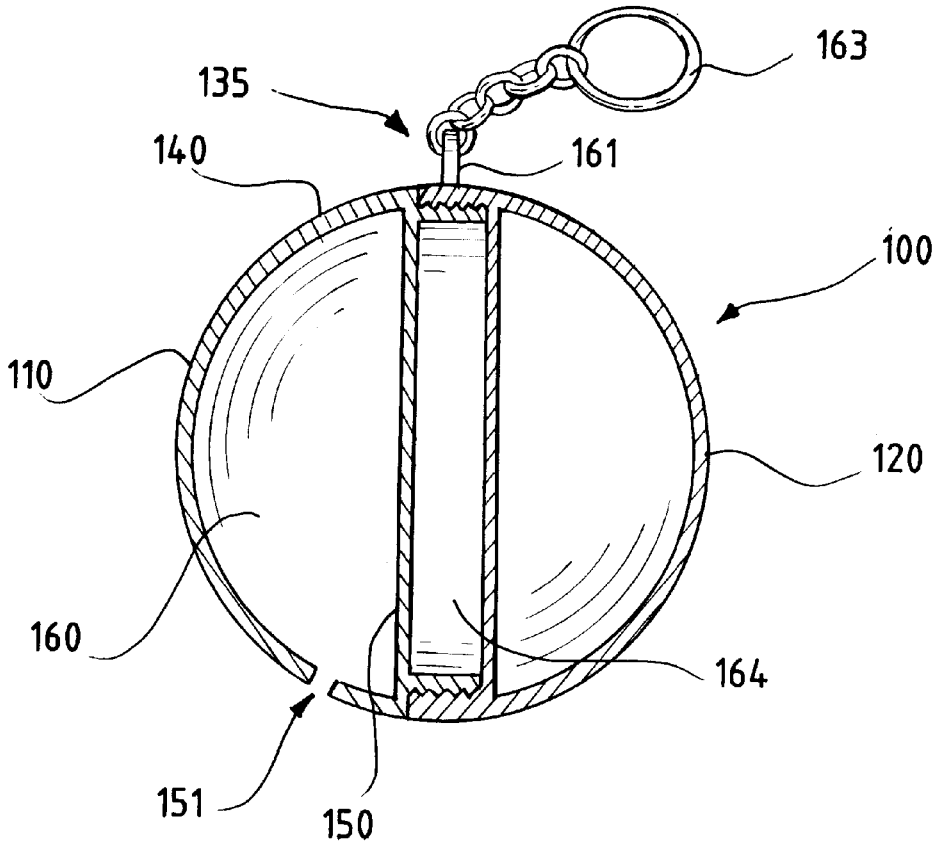
FIG. 9 is a cross-sectional view of another embodiment of the present invention.
Figure 10:
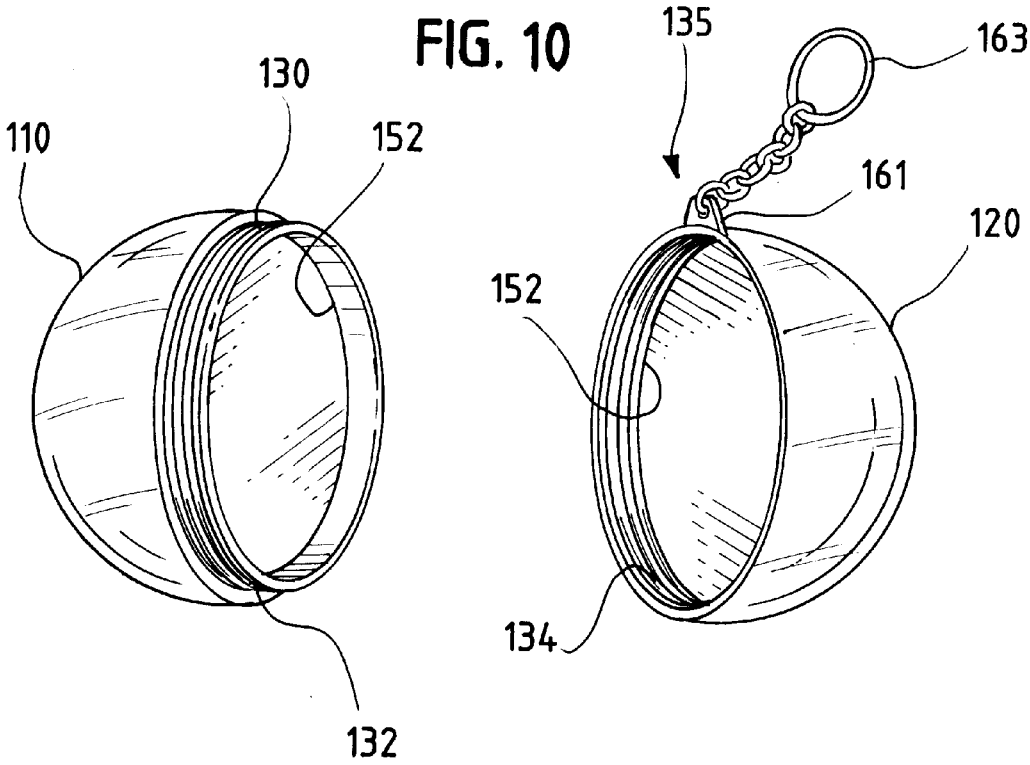
FIG. 10 is an exploded perspective view of another embodiment of the present invention.
Figure 11:
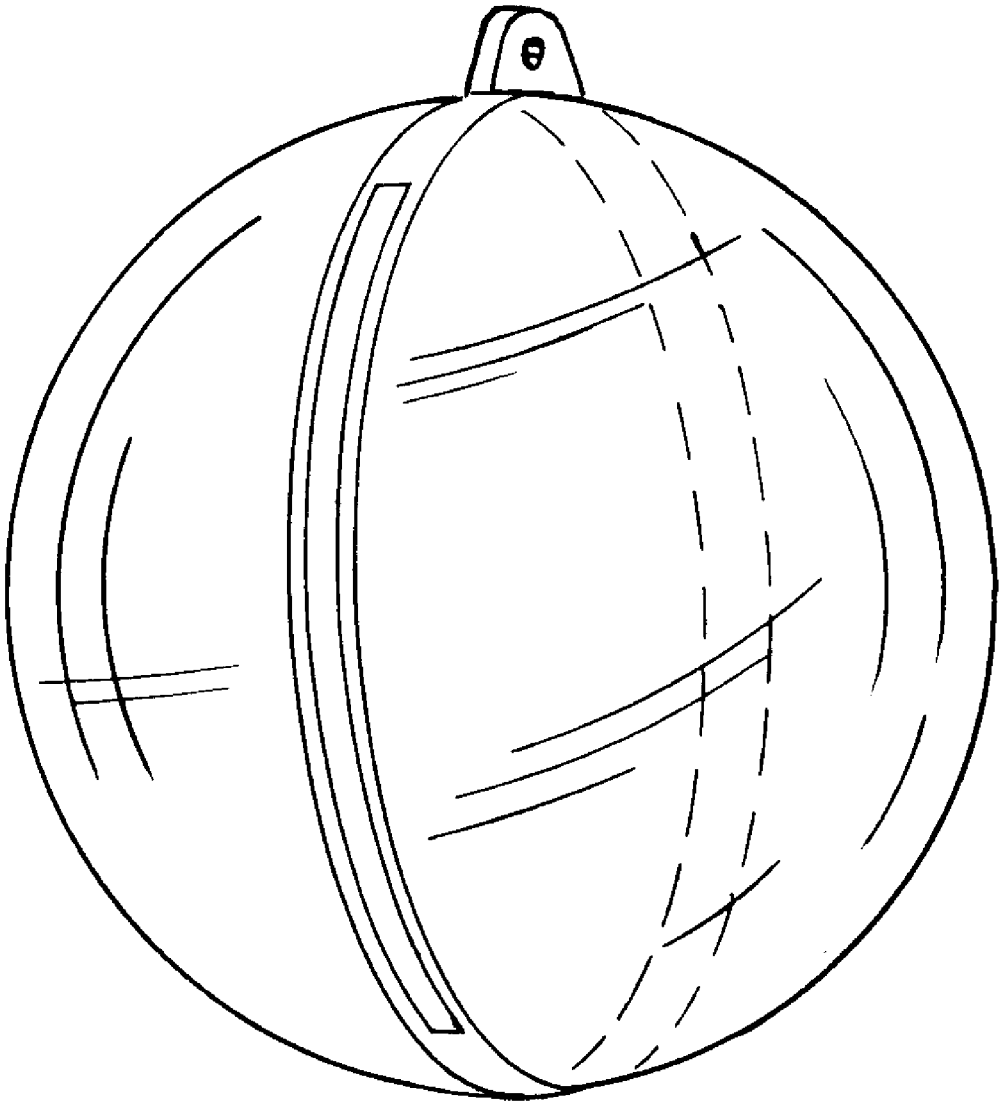
FIG. 11 is a perspective view of yet another embodiment of the present invention.

In another such embodiment, as shown in FIGS. 8, 9 and 10, the display chamber 30 may separate the housing into two separate fluid retention structures. Thus, the user can insert one fluid into the first fluid retention structure and a second fluid in the second fluid retention structure.

In yet another preferred embodiment, the invention may further comprise display item 100. Display item 100 includes first reservoir 110 and a second reservoir 120, means 130 for engaging the first and second reservoirs and attachment member 135.

First reservoir 110 is shown in FIG. 8 as comprising Outer wall 140, inner wall 150 and port 151. While first reservoir 110 is being described in detail, it will be understood that second reservoir 120 is substantially identical thereto. Outer wall 140 comprises a convex shape such as a portion 20 of a sphere. Of course, other shapes, such as cubes, prisms, and other multisided configurations, as well as certain non-uniform configurations are likewise contemplated for use. Inner wall 140 comprises a substantially flat, planar geometry. Of course, other geometries are contemplated for use. For example, the inner wall may comprise a variable thickness so as to magnify that which is positioned behind the inner wall and into abutment with same.

The inner wall 140 and the outer wall 150 are joined about edge 152 so as to define retaining region 160. The inner wall 140 and the outer wall 150 may comprise various clear or tinted materials that are at least partially transparent and/or translucent, such as a plastic or a glass material. Region 160 may be filled through port 151 with a solid, a fluid, multiple immiscible fluids, a fluid having a solid suspension therein, or any combination thereof. In the case of a fluid having a solid suspension, upon agitation of the fluid, the solid suspension appears to float within the fluid, giving the appearance of falling snow. Of course, the fluid can easily be observed by a user through the transparent/translucent portions of the inner and outer walls.

Engaging means 130 comprises threaded extension 132 positioned about edge 152 of first reservoir 110 and threaded portion 134 positioned about edge 152' of second reservoir 120. The threaded portions can be mated, which in turn, matingly engages the two reservoirs and defines display chamber 164 therebetween. Within display chamber 164, a photograph 170 or other substantially flat item can be positioned for viewing of same. In addition, two photographs can be positioned back to back so that one can be viewed through first reservoir 110 and the second can be viewed through second reservoir 120.

In another embodiment, the engaging means may comprise non threaded regions associated with each reservoir which are matingly engaged and retained by a press-fit structure. Of course, other engaging means of the two reservoirs are likewise contemplated for use, so long as such engaging means define cavity 164 upon engagement.

Attachment member 135 comprises hook 161 associated with one of the first and second reservoir and member 163. Member 163 is attached to hook 161 and may comprise a section of chain links which form a key chain. Alternatively, the member may comprise a rope, a hook or twine so that the novelty item can be used as a Christmas tree ornament or other decoration.

The foregoing description and drawings merely explain and illustrate the invention and the invention is not limited thereto except insofar as the appended claims are so limited, as those skilled in the art who have the disclosure before them will be able to make the modifications and variations therein without departing from the scope of the invention.

What is claimed is:

1. A novelty item comprising:

a first reservoir having an inner wall;

a second reservoir;

at least one of the first and second reservoirs having a liquid therein, and at least a portion of at least one of the first and second reservoirs being one of transparent or translucent;

means for engaging the first and second reservoirs, to in turn, define a display chamber therebetween;

said inner wall of said first reservoir comprises a substantially flat and planar geometry.

2. The novelty item of claim 1 wherein at least a portion of each of the first and second reservoirs is substantially transparent or translucent.

3. The novelty item of claim 1 wherein each of the first and second reservoirs include a liquid therein.

4. The novelty item of claim 3 wherein the liquid in each of the first and second reservoirs include at least one solid particle suspended therein.

5. The novelty item of claim 1 wherein the first reservoir includes a hemispherically shaped outer wall.

6. The novelty item of claim 5 wherein the outer wall of each of the first and second reservoirs comprises a hemispherical geometry.

7. The novelty item of claim 1 wherein the second reservoir includes a second reservoir inner wall having a substantially flat and planar geometry.

8. The novelty item of claim 1 wherein the engaging means comprises one of a pressfit engagement structure and a threaded engagement structure.

9. The novelty item of claim 1, further comprising an object contained within the display chamber.

10. The novelty item of claim 9 wherein the object comprises a photograph.

11. The novelty item of claim 9 wherein the object comprises two photographs positioned in a back to back orientation, to in turn, facilitate viewing of at least one photograph through each of the first and second reservoirs.

12. A novelty item, comprising:

a first reservoir having an inner wall;

a second reservoir;

at least one of the first and second reservoirs having a fluid therein, and at least a portion of at least one of the first and second reservoirs being one of transparent or translucent;

means for engaging the first and second reservoirs, to in turn, define a display chamber therebetween;

said inner wall of said first reservoir comprises a substantially flat and planar geometry; and said engaging means comprises a first threadform positioned on the first reservoir and a mating threadform positioned on the second reservoir.

13. A novelty item, comprising:

a first reservoir having an inner wall;

a second reservoir;

at least one of the first and second reservoirs having a fluid therein, and at least a portion of at least one of the first and second reservoirs being one of transparent or translucent;

means for engaging the first and second reservoirs, to in turn, define a display chamber therebetween;

said inner wall of said first reservoir comprises a substantially flat and planar geometry; and said fluid comprises at least two immiscible fluids.

14. A novelty item, comprising:

a first reservoir having an inner wall;

a second reservoir;

at least one of the first and second reservoirs having a fluid therein, and at least a portion of at least one of the first and second reservoirs being one of transparent or translucent;

means for engaging the first and second reservoirs, to in turn, define a display chamber therebetween;

said inner wall of said first reservoir comprises a substantially flat and planar geometry; and said first and second reservoirs each include at least one port capable of providing access to the reservoir.

15. A novelty item, comprising:

a first reservoir having an inner wall;

a second reservoir;

an attachment member associated with at least one of the first and second reservoirs;

at least one of the first and second reservoirs having a fluid therein, and at least a portion of at least one of the first and second reservoirs being one of transparent or translucent;

means for engaging the first and second reservoirs, to in turn, define a display chamber therebetween; and said inner wall of said first reservoir comprises a substantially flat and planar geometry.

16. The novelty item of claim 15 wherein the attachment member further includes a key chain.

17. The novelty item of claim 15 wherein the attachment member further includes a hook for attachment to an outside structure for decoration.

* * * * *

UNITED STATES PATENT AND TRADEMARK OFFICE

CERTIFICATE OF CORRECTION

PATENT NO. : 6,438,878 B1 
DATED : August 27, 2002
INVENTOR(S) : Fine, Neil, Lam, Cliff and Wan, Tsuen It is certified that error appears in the above-identified patent and that said Letters Patent is hereby corrected as shown below:

Column 1,
Line 5, replace "09/044,039." with -- 09/044,039, --
Line 24, replace "Further more" with -- Furthermore --

Column 5,
Line 28, replace "portion 20" with -- portion --

Signed and Sealed this

Eighteenth Day of February, 2003

JAMES E. ROGAN
*Director of the United States Patent and Trademark Office*